United States Patent [19]

Terry

[11] 4,099,567

[45] Jul. 11, 1978

[54] GENERATING MEDIUM BTU GAS FROM COAL IN SITU

[75] Inventor: Ruel Carlton Terry, Denver, Colo.

[73] Assignee: In Situ Technology, Inc., Denver, Colo.

[21] Appl. No.: 801,223

[22] Filed: May 27, 1977

[51] Int. Cl.[2] ..... E21B 43/24; E21B 43/26; E21C 43/00

[52] U.S. Cl. ..... 166/261; 166/259; 175/4.57

[58] Field of Search ..... 166/261, 50, 258, 259, 166/256, 272, 251, 297, 298, 308, 271; 299/4; 175/4.51, 4.57, 4.58, 4.59, 4.6

[56] References Cited

U.S. PATENT DOCUMENTS

| | | | |
|---|---|---|---|
| 2,193,144 | 3/1940 | Rymal | 166/292 |
| 2,695,163 | 11/1954 | Pearce et al. | 166/259 X |
| 2,952,449 | 9/1960 | Bays | 166/271 X |
| 3,004,594 | 10/1961 | Crawford | 166/259 |
| 3,010,707 | 11/1961 | Craighead et al. | 166/258 X |
| 3,537,529 | 11/1970 | Timmerman | 166/271 |
| 3,599,714 | 8/1971 | Messman et al. | 166/258 |
| 3,734,184 | 5/1973 | Scott | 166/259 |
| 3,775,073 | 11/1973 | Rhoades | 166/259 X |
| 3,794,116 | 2/1974 | Higgins | 166/259 |
| 4,010,800 | 3/1977 | Terry | 166/258 |
| 4,015,663 | 4/1977 | Strubhar | 166/258 |

*Primary Examiner*—Stephen J. Novosad

[57] ABSTRACT

Medium BTU gas is generated from coal in situ by establishing communication channels through the coal in part by projectiles and in part by burning. Oxygen is employed for reaction with the coal and reaction temperatures are controlled by injection of steam.

9 Claims, 2 Drawing Figures

GENERATING MEDIUM BTU GAS FROM COAL IN SITU

BACKGROUND OF INVENTION

It is well known in the art how to generate medium BTU gas from coal in above ground gasifiers. For this purpose a particular type of coal is selected so that the above ground gasifier will not become clogged during the process. The coal is mined, transported from the mine to the gasifier site, crushed to the proper lump size, then charged into the gasifier which is operated at a pressure above atmospheric. Since the gasifier is pressurized, suitable mechanical pressure locking chambers must be employed in order to feed the coal in steps from atmospheric pressure to the operative pressure required. The coal is then burned with oxygen and the ash is collected in mechanical pressure locking chambers so that the ash may be removed at atmospheric pressure. The gasifier itself is primarily a pressure vessel made of metal parts, and it is necessary to control combustion temperatures so that metal parts are not damaged. Generally it is desirable to control temperatures below that of the fusion temperature of the ash so that the ash may be removed as a dry solid rather than in molten form. Temperature control is normally provided by injecting steam along with the oxygen into the gasifier, with ratios of steam injected to coal consumed in the order of pound for pound. In this manner medium BTU gas, in the range of 400 to 600 BTUs per standard cubic foot, is generated.

In the production of coal in situ in some cases it may be desirable to control underground combustion temperatures below the fusion point temperature of the ash in order to keep the ash from flowing underground in molten form. In situ production of coal requires no metal parts in the reaction zone, therefore temperature control to protect metal parts is not needed. Thus less steam is required for temperature control while generating a medium BTU gas. Further, the ash is left underground rather than creating the disposal problem which is inherent in above ground gasifiers.

Generally the prior art methods for production of coal in situ do not provide for temperature limits in the underground reaction zone. The use of steam in alternate cycles is taught in U.S. Pat. No. 4,018,481 of the present inventor. Another use of steam is taught in U.S. Pat. No. 3,794,116 of Higgins wherein it is necessary first to rubblize the underground coal.

It is well known in the art how to fire projectiles underground to establish communications between a well bore and producing horizon such as an oil saturated sand stratum. In this case a perforating gun is lowered into a well bore opposite the oil bearing stratum, and multiple shots are fired with the projectiles penetrating the well casing, the cement between the well casing and the well bore, and into the oil sand until the momentum of the projectile is spent. In this manner openings are created in the casing and cement, and channels are formed in the oil sand. Such channels may have a length of a few inches and in some cases as much as 10 feet. The object of such channels to provide free flowing communications passages through the underground oil sand, particularly in the immediate vicinity of the well bore which may have become impervious to the passage of fluids due to invasion of drilling mud during the drilling operations.

It is well known in the art how to produce coal in situ using vertical and linked wells. Two or more wells are bored from the surface of the ground into the coal deposit. Compressed oxidizer is injected into one well and eventually a portion of the oxidizer will reach the second well, at which time the coal in the second well is ignited. By continuing injection of oxidizer in the first well, the fire will propagate through the coal toward the on coming oxygen and will eventually burn a channel linking the two wells underground.

It is common in underground coal deposits that a system of cracks is found within the coal. These cracks, sometimes called cleats, form a general geometric pattern with one series of cleats being generally perpendicular to the other series of cleats that traverses the coal deposit. The coal itself generally has very low permeability for the passage of fluids, but often one series of cleats will have a considerable amount of permeability with 300 millidarcies not being uncommon. The preponderance of the oxidizer passing through the coal seam, as heretofore mentioned, proceeds from one well to the next through the series of cleats in the coal.

The oxidizer under the influence of differential pressure proceeds primarily through paths of least resistance through the coal seam. The path through the coal seam carrying the maximum oxidizer flow will be the path of the channel when two wells are linked by an underground burn. Such a path generally is quite circuitous in its traverse and may deviate substantially from a straight line drawn between the two wells. The pattern of wells drilled for in situ production of coal generally conforms to a predetermined geometric pattern such as a series of rows of wells in parallel with each other. Significant meanderings of the underground channels burned in the coal tend to render ineffective any preplanned well pattern. Therefore it is desirable to burn underground channels with minimum deviations from straight lines in order to assure that large portions of the underground coal will not be bypassed as the in situ processes proceed.

It is an object of the present invention to teach the control of temperatures in the underground reaction zone while generating a medium BTU gas. It is another object of the present invention to teach methods of burning underground channels through a coal seam with minimum deviations from the planned directions for such channels. Other objects, capabilities and advantages of the present invention will become apparent as the description proceeds.

SUMMARY OF INVENTION

A pattern of wells is established for the production of coal in situ. A portion of the pattern is drilled and the wells are equipped for injection of fluids into and withdrawal of fluids from an underground coal seam. A perforating gun is lowered into each well and a projectile is fired in the direction of the desired underground linkage. The underground linkage is completed by burning an underground channel through the coal. The hot channels in the underground coal are then used to propagate in situ combustion of the coal. Combustion is sustained by continuous injection of oxygen and combustion temperatures are moderated by continuous injection of steam. The products of the underground reactions are captured at the surface.

DESCRIPTION OF THE PREFERRED EMBODIMENT

For illustrative purposes a coal seam is described at a depth of 500 feet below the surface. The coal seam is approximately 30 feet thick and has a permeability of approximately 300 millidarcies along one series of cleats and approximately 20 millidarcies along another series of cleats. A series of wells is drilled from the surface of the ground and into the coal seam. The wells are hermetically sealed so that reaction zones can be created in the coal seam and so that the reaction zones may be pressurized to the desired mine pressure.

Figure 1:
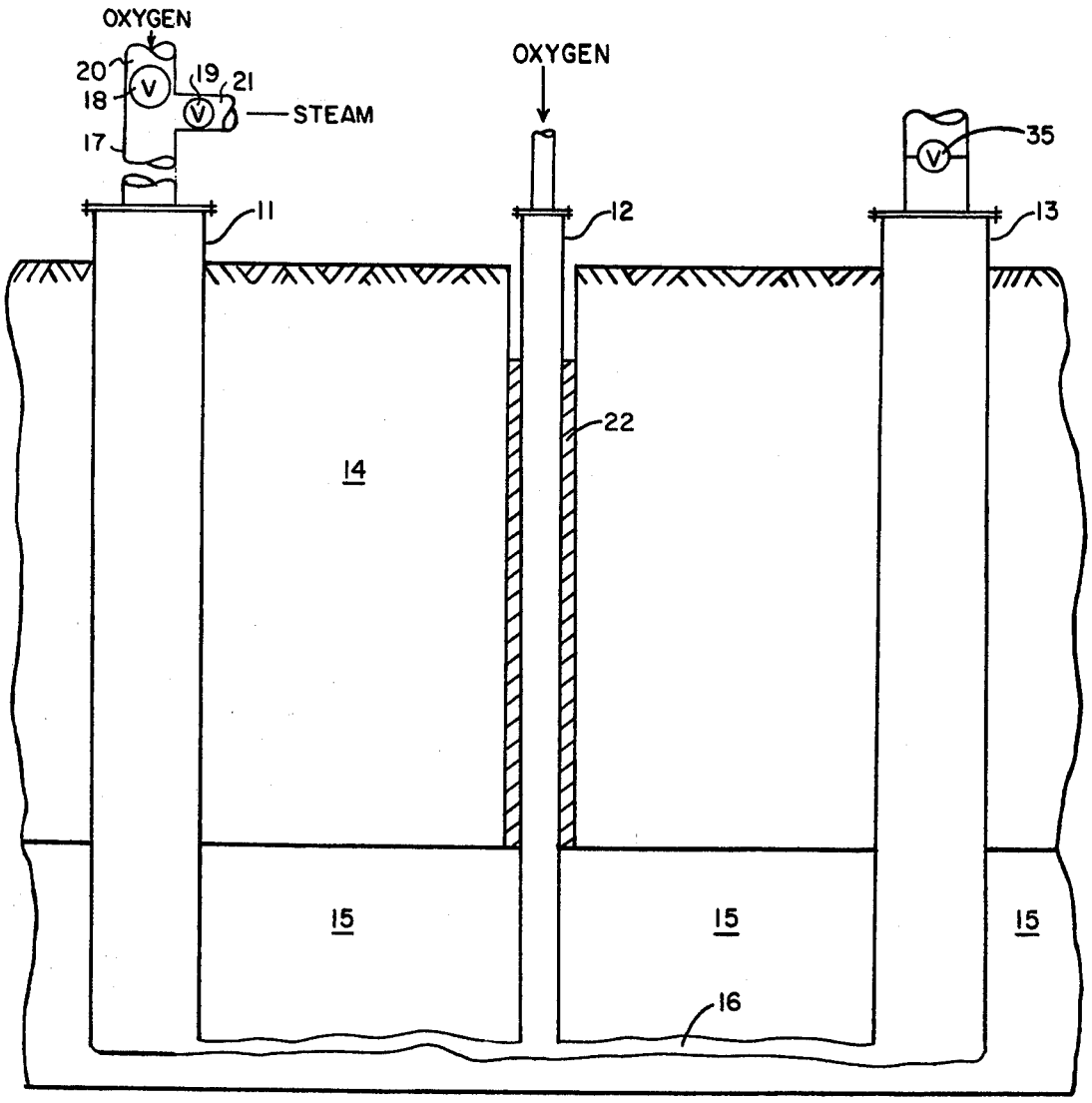
FIG. 1 is a diagrammatic vertical section of a portion of the earth showing the overburden, an underground coal seam and three wells used in the methods of the present invention.

Referring to FIG. 1, well 11 is drilled through overburden 14 and into coal seam 15. The well is cased 22 and fitted with a suitable well head 17. The well head contains flow line 20 with valve 18 and flow line 21 with valve 19. Well 11 as illustrated in equipped as an injection well for the production of medium BTU gas and has connected to it a source of oxygen and a source of steam. It is desired that the system be operated for high performance, for example an input of injected fluids equivalent of 20 million standard cubic feet per day. Casing 22 would be for example 20 inches in diameter.

Well 12 is an auxiliary well located for example between wells 11 and 13. Well 12 is drilled into the coal and is equipped with injection tubing. The hermetic seal for well 12 is accomplished by a column of drilling mud 22 located in the annulus between the tubing and the well bore. The tubing could be, for example $2\frac{7}{8}$ inches in diameter. Well 11, before it is equipped, is used to initiate the underground channel between wells 11 and 13, and after equipping as an oxidizer injection well to burn the channel between wells 11 and 13. After the channel burn is completed, the tubing is withdrawn from well 12 and the well is sealed, preferably by a cement plug positioned in the overburden 14 immediately above the coal seam 15 with the balance of the seal effected by a column of drilling mud in the borehole.

Well 13 as illustrated is drilled and cased similar to well 11, but has well head fittings for the recovery of the produced gases. By changing the well head fittings, well 13 may also serve as an injector well. Upon completion of the linkage burn as described hereinafter, wells 13 and 11 are linked and ready for production of the coal in situ.

Figure 2:
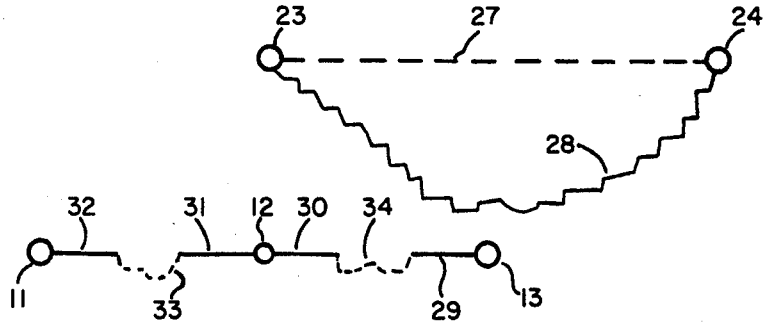
FIG. 2 is a plan view showing a possible well pattern with two rows of wells and paths of underground channels.

Referring to FIG. 2, a portion of the wells in two rows are shown. The wells could be on a line drive pattern with well spacings for example of 300 feet. In order to get a proper sweep of the underground coal it is desirable that all wells be linked together through the coal seam. It is further desirable that such linkage be accomplished in a straight line 27 as illustrated between wells 23 and 24. By injecting oxygen into well 23 and upon oxygen break-through at well 24, the coal can be ignited in well 24 and in time a channel can be burned between and linking the wells. In previous experimentation in Wyoming coal it has been determined that the burned channel 28 may stray considerably from the desired path 27. As illustrated the channel very nearly encountered well 13, and upon attempting in situ combustion, the burn pattern may bypass a considerable amount of coal located near the center of line 27.

When natural linkage patterns deviate substantially from a straight line, other measures must be taken to assure the symmetry of the underground burn. For example if it is planned to link well 11 with well 13, a perforating gun may be lowered into well 13 with the projectile fired toward well 11 creating a projectile channel. In contrast to perforations in the petroleum industry, the projectile does not have to open a hole through a cemented casing, therefore the projectile channel through the coal will be substantially longer than that commonly experienced in oil formations. The perforating gun can be lowered into well 12 and fired first toward well 13 creating projectile channel 30, then toward well 11 creating projectile channel 31. Then the perforating gun is lowered into well 11, fired toward well 13 and creating projectile channel 32. A more nearly straight linkage may then be made between wells 11 and 13 by injecting oxygen into auxiliary well 12, igniting the coal in wells 11 and 13, and burning a channel between wells 11 and 13 upon burn-through to well 12. By following such a procedure deviations 33 and 34 caused by irregular permeabilities in the coal are of minor consequence. The burn channel between wells 11 and 13 then would follow the paths 32, 33, 31, 30, 34, and 29 and would afford a much more satisfactory in situ production performance than would burn channel 28 between wells 23 and 24.

Well 12 may now be plugged and abandoned as described heretofore. In some cases well 12 will not be required in the program, particularly when it is possible to burn a reasonably straight channel between wells 11 and 13, when wells 11 and 13 are close enough together that the projectile channels substantially link the wells, and the like.

With a linkage channel between wells 11 and 13, in situ production of coal seam 15 may be undertaken. In the aforementioned procedures for establishing the burned channel, the projectile channels and the burn channels 33 and 34 will be enlarged to an effective cross section of for example 20 square inches. Coal abutting on the linkage channel will be at a temperature well above its ignition point temperature, and will readily burn upon resumption of oxygen injection through the circuit. For convenience of reference the channel between wells 11 and 13 as shown on FIG. 2 is identified on FIG. 1 as linkage channel 16.

The process of generating medium BTU gas, for example in the range of 400 to 600 BTUs per standard cubic foot, begins by closing all valves. Referring to FIG. 1, valve 18 is opened and oxygen is injected through well 11 into channel 16. Injection is continued with valve 35 closed until planned mine pressure is attained in channel 16, for example 200 psig. Valve 35 is then opened to the extent necessary to maintain the desired mine pressure. The coal abutting on channel 16 will react with the oxygen creating an oxidizing environment in the portion of channel 16 nearest well 11 and a reducing environment in the portion of channel 16 nearest well 13. Coal adjacent to channel 16 will increase in temperature into the pyrolysis range and will expel volatile matter into channel 16. Some of the volatiles, particularly that portion entering channel 16 near well 11 will be consumed in the combustion process.

Some of the volatiles, particularly those entering channel 16 near the midpoint of the channel will be thermally cracked into high BTU gases. Some of the volatiles, particularly those entering channel 16 near well 13 will be entrained in the gas stream and be delivered to the surface via well 13. The length of channel 16 has a direct bearing on the conversion of pyrolysis gases, therefore if it is desirable to have the gases of pyrolysis uneffected in part channel 16 must be long enough, for example 300 feet, so that a portion of the pyrolysis gases will not be subjected to cracking temperatures.

Combustion temperatures in channel 16 near well 11 may reach maximums in the order of 3,000° F, a temperature well above the fusion point temperature of the ash contained in the coal. If such temperatures are permitted, the ash will become molten and free flowing under the influence of gravity. Generally it is undersirable to have ash in the molten state, particularly in coal seams that dip and thus cause the molten ash to accumulate at the lowest permeable point.

Temperatures in the reaction zone of channel 16 may be moderated by injecting water, preferably in the form of steam. The steam is decomposed upon encountering incandescent carbon in the well known water gas reaction which yields hydrogen and carbon monoxide, both of which are fuel gases with a BTU content greater than 300 BTUs per standard cubic foot. The water gas reaction is endothermic and thus serves to lower the temperature in the reaction zone as well as generate useful fuel gases.

Temperature control is applied by opening valve 19 and injecting steam along with oxygen into the circuit via well 11. The steam may be injected in the range of 0.1 to 1.0 pounds of steam for each pound of coal consumed in the processes, preferably 0.4 when the fusion point temperature of the ash is 2400° F or higher.

The resulting product gas delivered to the surface via well 13 will be a composite gas composed primarily of hydrogen, carbon monoxide, cracked gases of pyrolysis, uncracked gases of pyrolysis and hydrogen sulfide. The composite gas will correspond to that generated by an above ground gasifier and will mornally be a gas of about 480 BTU per standard cubic foot.

Near the end of the production sequences it is desirable to assure that all of the coal will be consumed in situ, or that if coal remains such coal is lowered in temperature below its ignition point temperature. The remnant coal may be consumed by terminating oxygen injection and continuing injection of water. The water gas reaction will consume coal as the coal temperature is lowered, producing carbon monoxide, hydrogen and carbon dioxide. At about 800° F the coal no longer enters the reaction. Residual heat in the coal, the ash from the coal and the surrounding overburden may be recovered by the continued injection of water. Steam thus generated can be used for any practical purpose, but more particularly may be used in a nearby in situ coal production project. In some cases the injection of water into the hot zone may be accomplished by reducing the mine pressure to permit free ingress of underground water in the coal nearby or from other water bearing formations.

What is claimed is:

1. A method of producing coal in situ comprising the steps of sinking a first bore hole from the surface of the earth into an underground coal deposit, sinking a second bore hole from the surface of the earth into the said underground coal deposit, the said second bore hole being spaced apart from the said first bore hole, establishing hermetic seals within the said first and second bore holes, establishing a communication passage through the said underground coal, the said communication passage being in fluid communication with the said first bore hole and the said second bore hole, the said communication passage through the said underground coal being accomplished by lowering a perforating gun into the said first bore hole, the said perforating gun being positioned within the said underground coal and the said perforating gun being aligned toward the said second bore hole, then firing a first projectile from the said perforating gun;

removing the said perforating gun from the said first bore hole, lowering the said perforating gun into the said second bore hole, the said perforating gun being positioned within the said underground coal and the said perforating gun being aligned toward the trajectory of the said first projectile fired from the said first bore hole, then firing a second projectile from the said perforating gun, and removing the said perforating gun from the said second bore hole, and further including the enlargement of the said communication passage through the said underground coal, comprising the steps of injecting oxygen in the said first well bore, igniting the said coal in the said second well bore, continuing injections of the said oxygen until the underground fire burns through to the said first well bore.

2. The method of claim 1 wherein generation of medium BTU gas is established, comprising the steps of terminating injection of the said oxygen, injecting a reactant fluid into the said first well bore, and withdrawing the products of reaction through the said second well bore.

3. The method of claim 2 wherein the said reactant fluid is a mixture of oxygen and steam.

4. The method of claim 3 wherein after a substantial amount of the said underground coal has been consumed and it is desirable to lower the temperature of the residual coal below its ignition point temperature, further including the steps of terminating injection of the said mixture of oxygen and steam, then injecting water as the said reactant fluid.

5. The method of claim 2 further including the step of positioning the said first well bore with relation to the said second well bore so that the said communication passage through the said coal is of sufficient length to permit a portion of the products of pyrolysis to be recovered without further reaction.

6. A method of producing coal in situ comprising the steps of sinking a first bore hole from the surface of the earth into an underground coal deposit, sinking a second bore hole from the surface of the earth into the said underground coal deposit, the said second bore hole being spaced apart from the said first bore hole, establishing hermetic seals within the said first and second bore holes, establishing a communication passage through the said underground coal, the said communication passage being in fluid communication with the said first bore hole and the said second bore hole, the said communication passage through the said underground coal being accomplished by lowering a perforating gun into the said first bore hole, the said perforating gun being positioned within the said underground coal and the said perforating gun being aligned toward the said second bore hole, then firing a first projectile from the said perforating gun;

removing the said perforating gun from the said first bore hole, lowering the said perforating gun into the said second bore hole, the said perforating gun being positioned within the said underground coal and the said perforating gun being aligned toward the trajectory of the said first projectile fired from the said first bore hole, then firing a second projectile from the said perforating gun, and removing the said perforating gun from the said second bore hole, and further including the enlargement of the said communication passage through the said underground coal comprising the steps of sinking a third bore hole from the surface of the earth into the said underground coal, the said third bore hole being in fluid communication with the said communication passage through the said underground coal, the said third bore hole being spaced apart from the said first bore hole and the said second bore hole, establishing an hermetic seal within the said third well bore, injecting oxygen through the said third bore hole and into the said communication passage through the said coal, igniting the said coal in the said first bore hole, igniting the said coal in the said second bore hole, and continuing injection of the said oxygen until the underground fire burns through to the said third well bore.

7. The method of claim 6 wherein the hermetic seal is attained, comprising the steps of installing an injection tubing within the said third well bore from the surface of the earth to within the said underground coal, and establishing a column of mud located in the annulus between the said tubing and the walls of the said third well bore.

8. The method of claim 6 wherein generation of medium BTU gas is established comprising the steps of terminating injection of the said oxygen through the said third well bore, shutting in the said third well bore, injecting reactant fluid into the said first well bore, and withdrawing the products of reactions through the second well bore.

9. The method of claim 8 wherein the said reactant fluid is a mixture of oxygen and steam.

* * * * *